US007520721B2

(12) United States Patent
Hamlin et al.

(10) Patent No.: US 7,520,721 B2
(45) Date of Patent: Apr. 21, 2009

(54) SYSTEM AND METHOD FOR ALIGNING AND SEALING A TURBINE SHELL ASSEMBLY

(75) Inventors: Michael Thomas Hamlin, Burnt Hills, NY (US); Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 469 days.

(21) Appl. No.: 11/533,159

(22) Filed: Sep. 19, 2006

(65) Prior Publication Data

US 2008/0069691 A1 Mar. 20, 2008

(51) Int. Cl.
*F01D 25/24* (2006.01)

(52) U.S. Cl. ..... 415/213.1; 415/108; 415/214.1; 415/220; 29/869.2

(58) Field of Classification Search ..... 415/108, 415/213.1, 214.1, 220; 29/889.2
See application file for complete search history.

(56) References Cited

U.S. PATENT DOCUMENTS

| | | | | |
|---|---|---|---|---|
| 3,498,727 | A * | 3/1970 | Bollinger, Jr. et al. | 415/136 |
| 3,592,557 | A * | 7/1971 | Haas et al. | 415/136 |
| 3,754,833 | A * | 8/1973 | Remberg | 415/108 |
| 6,244,819 | B1 * | 6/2001 | Voorhees | 415/213.1 |
| 6,402,468 | B1 | 6/2002 | Florin et al. | |
| 7,273,348 | B2 * | 9/2007 | Amirtharajah et al. | 415/214.1 |

* cited by examiner

*Primary Examiner*—Igor Kershteyn
(74) *Attorney, Agent, or Firm*—Cantor Colburn LLP

(57) ABSTRACT

Disclosed is a system for aligning and sealing a turbine shell assembly an first shell assembly including at least one first shell segment, a second shell assembly including a tongue extending therefrom, a groove defined by the first shell assembly, the groove configured to mate with the tongue extending from the second shell assembly, at least one key structure disposable in the groove, the at least one key structure being associable with at least one surface of the at least one first shell segment, and at least partially sealable with a sealing surface of the tongue, and a tapered surface of the groove that is associable with at least a portion of the at least one key structure.

20 Claims, 6 Drawing Sheets

SYSTEM AND METHOD FOR ALIGNING AND SEALING A TURBINE SHELL ASSEMBLY

FIELD OF THE INVENTION

This disclosure relates generally to a system and method for aligning and sealing a turbine shell assembly, and more particularly to a system and method for aligning and sealing a turbine shell assembly including a male-to-female fit.

BACKGROUND OF THE INVENTION

In double shell type turbine construction, axial alignment of an outer shell to an inner shell is generally accomplished by male-to-female components on the inner and outer shells of the turbine. The male-to-female fit components include at least one groove (female) defined by the inner shell or outer shell and at least one tongue (male) extending from the inner shell or outer shell. Pressure and temperature conditions in the turbine sometimes cause the tongue components to creep and distort. Because the female-to-male components align and seal via metal-to-metal contact, creep and distortion in the tongue must be machined out of the tongue in order to allow proper sealing with a replacement shell groove. In particular, a sealing surface or surfaces of the tongue component(s) will be machined to regain a perpendicular face with respect to a turbine centerline, allowing for the creation of the seal between the components. This machining of the tongue component(s) takes place in the field during turbine outages, and requires substantial downtime and costs in terms of tools and labor.

BRIEF DESCRIPTION OF THE INVENTION

Disclosed is a system for aligning and sealing a turbine shell assembly an first shell assembly including at least one first shell segment, a second shell assembly including a tongue extending therefrom, a groove defined by the first shell assembly, the groove configured to mate with the tongue extending from the second shell assembly, at least one key structure disposable in the groove, the at least one key structure being associable with at least one surface of the at least one first shell segment, and at least partially sealable with a sealing surface of the tongue, and a tapered surface of the groove that is associable with at least a portion of the at least one key structure.

Also disclosed is a method for aligning and sealing a turbine shell assembly, the method including disposing at least one key structure in a groove of a first shell assembly, disposing a tongue of a second shell assembly in the groove, fitting the first shell assembly with the second shell assembly via the disposing of said tongue in the groove, moving at least a portion of the at least one key structure towards a tapered surface of the groove, guiding at least a portion of the at least one key structure into contact with the tongue via contact between at least a portion of the at least one key structure and the tapered surface of the groove, and creating an outer pressure seal between at least a portion of the at least one key structure and the tongue via the moving and the guiding.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION OF THE INVENTION

Figure 1:
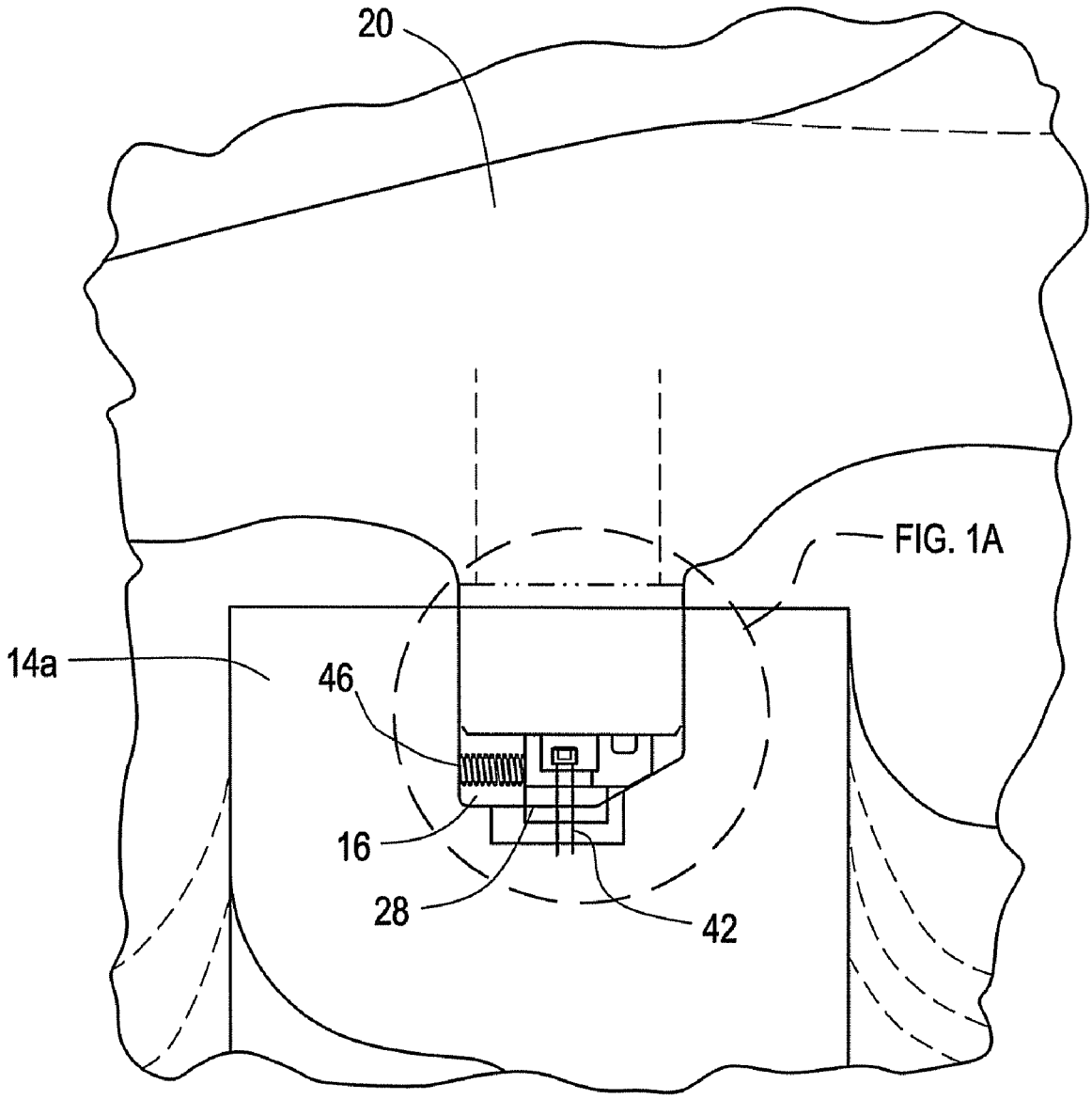
FIG. 1 is a schematic, cross-sectional view of a system for aligning and sealing a turbine shell assembly.
Figure 1A:
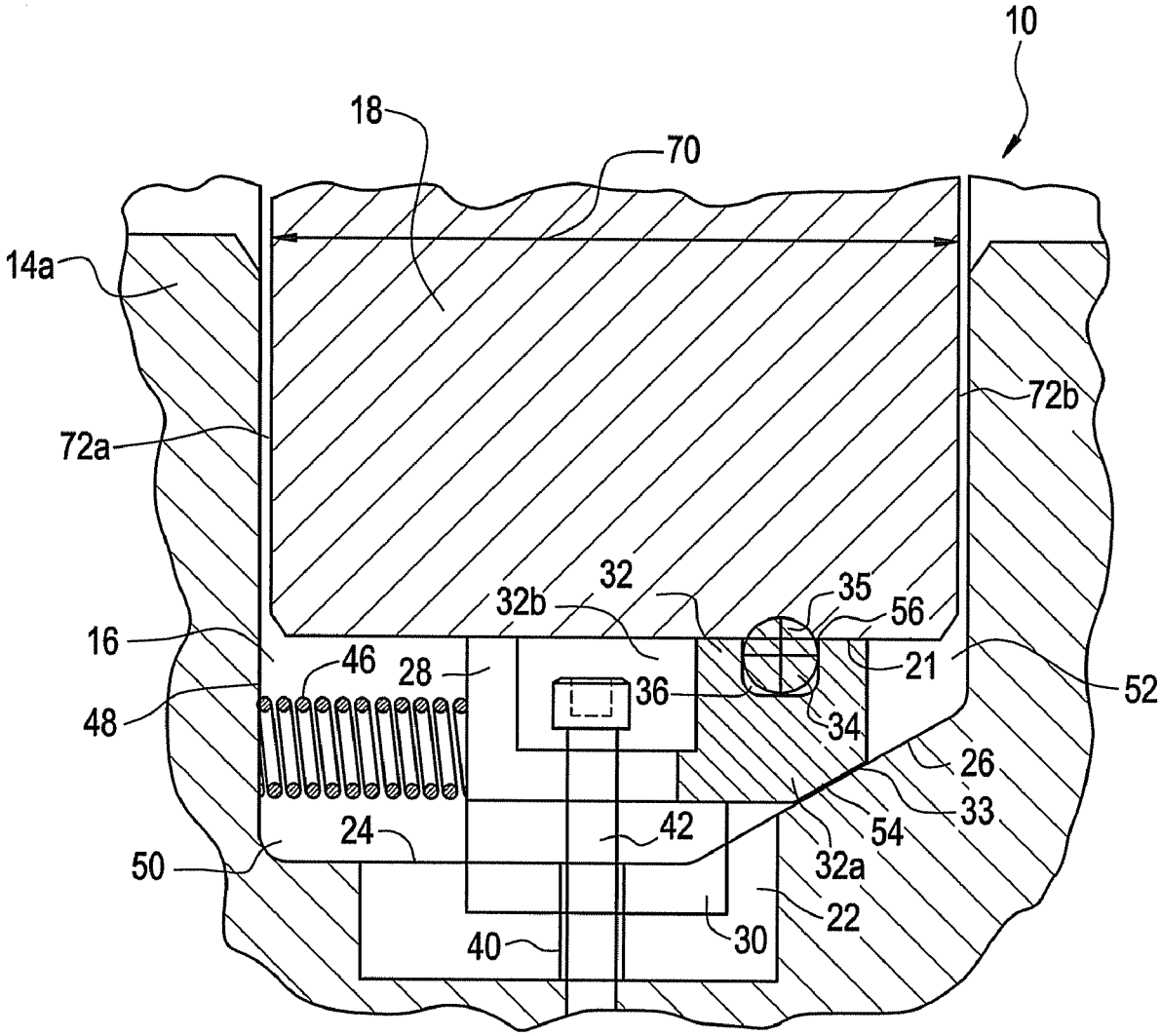
FIG. 1A is a magnified view of region 1 in FIG. 1.
Figure 2:
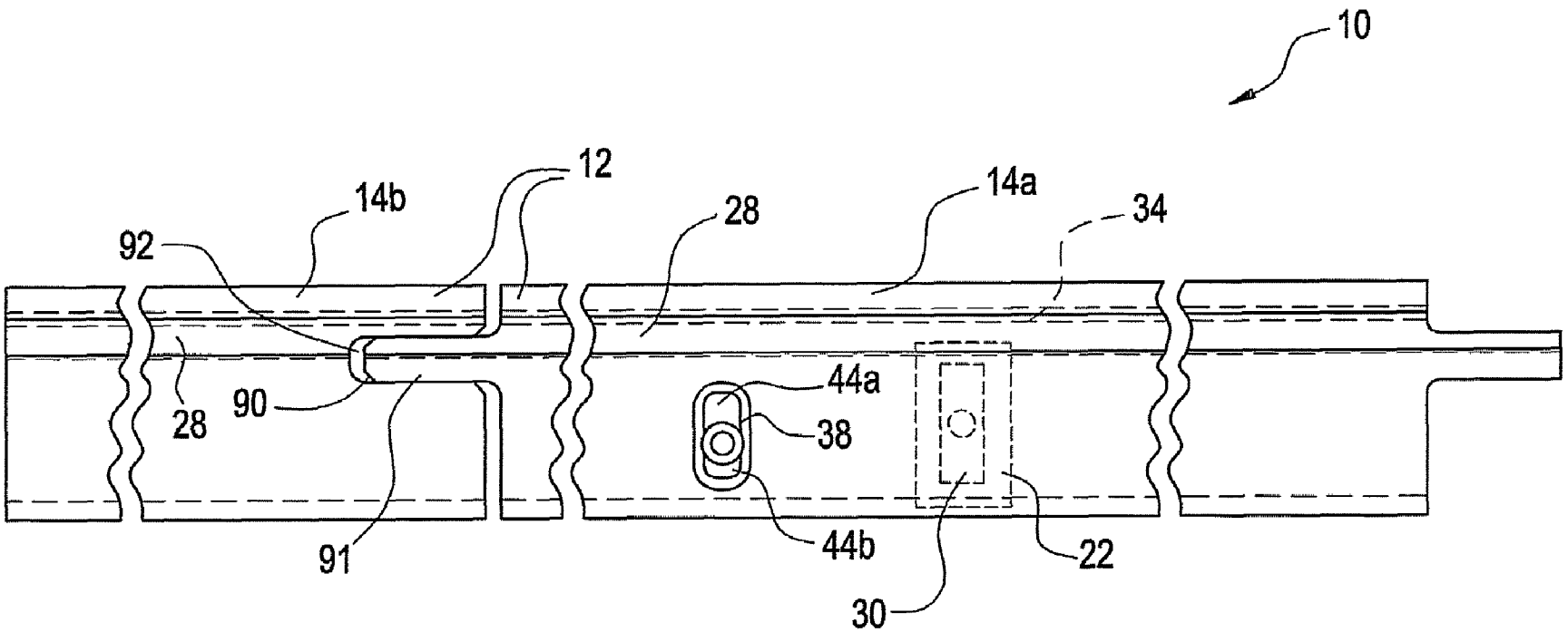
FIG. 2 is a schematic plan view of an axial tongue and groove fit in a system for aligning and sealing a turbine shell assembly.
Figure 3:
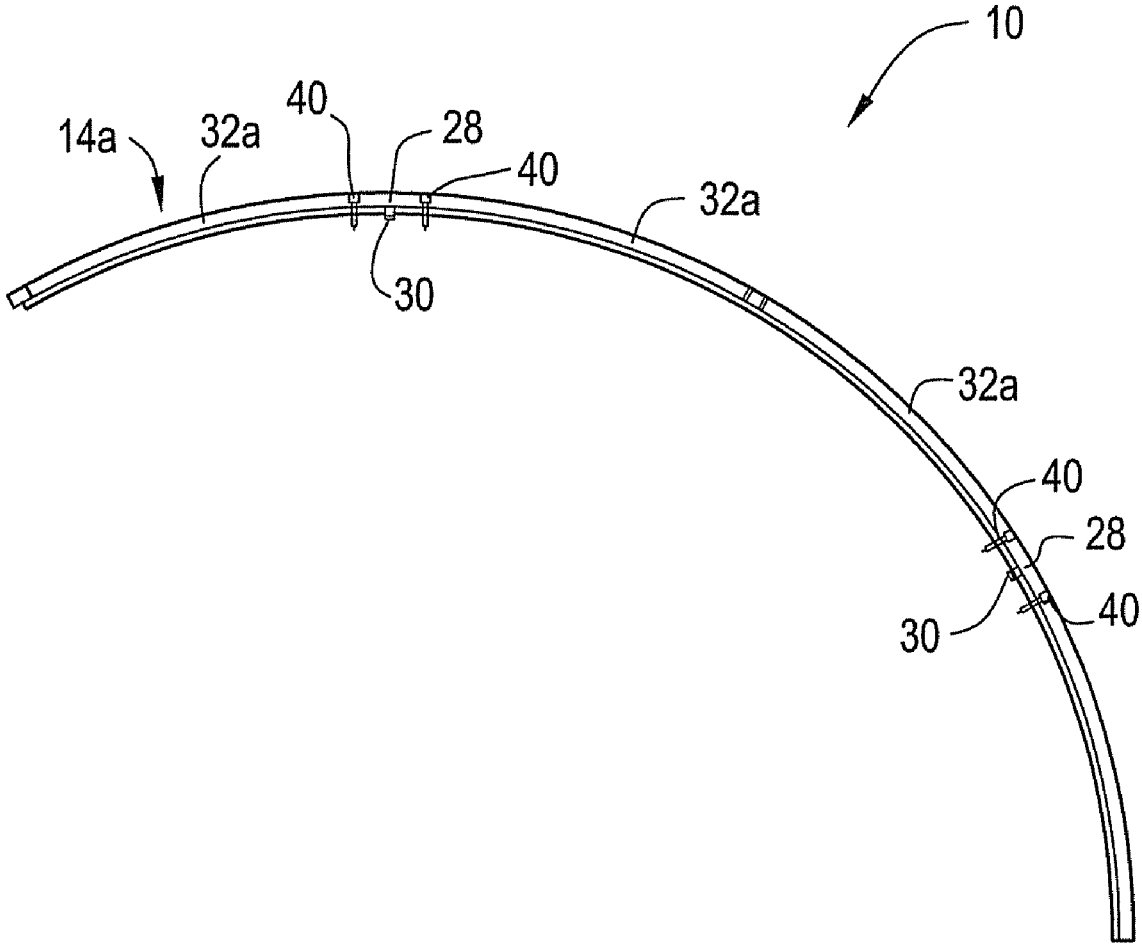
FIG. 3 is a schematic, partial cross-sectional view of an axial tongue and groove fit in a system for aligning and sealing a turbine shell assembly.

Referring to FIGS. 1-3, a system 10 for aligning and sealing a turbine shell assembly is illustrated. The system 10 allows a new or replacement shell assembly to align and seal with an existing shell assembly (though both parts could be new, such as in a belt and suspenders design) without requiring machining of a male component portion of the outer shell assembly. Thus, during retrofit of the outer shell (for association with the new inner shell), turbine downtime and labor/tool cost associated with machining creep and distortion out of the male component of the existing shell assembly can be avoided. The system 10 includes a 360 degree first shell assembly 12 (a portion of which being illustrated) comprising at least one first shell segment 14*a*-*b* and defining a groove 16. The first shell segments 14*a*-*b* join to form a circumferential assembly, with the defined groove 16 (defined partially by each segment) running 360 degrees around the first shell assembly 12. The groove 16 is configured to mate with a tongue 18 that extends from a 360 degree second shell assembly 20, which includes at least two, second shell segments (not illustrated) joined to form the assembly 20. The tongue 18 includes a sealing surface 21. The groove 16 also includes an association surface 24, a tapered surface 26, and at least one alignment slot 22. In an exemplary embodiment, the tapered surface 26 is angled away from the association surface 24, towards the sealing surface 21 of the tongue 18, as shown in FIG. 1. Respective functionality of the alignment slot 22, association surface 24, and tapered surface 26 will be discussed in greater detail further along in the disclosure. The first shell assembly 12 and second shell assembly 20, and their respective features and components, are used in a double shell-type turbine construction (which is not fully illustrated). It should be appreciated that the first shell assembly 12 may be an inner shell assembly including inner shell segments (correlating with shell segments 14*a*-*b*), and the second shell assembly 20 may be an outer shell assembly. It should also be appreciated that the first shell assembly 12 may be an outer shell assembly including outer shell segments (correlating with shell segments 14*a*-*b*), and the second shell assembly 20 may be an inner shell assembly. However, as the Figures illustrate the first shell assembly 12 as an inner shell and the second shell assembly 20 as an outer shell assembly, the inner shell assembly and inner shell segments will be referred to hereinafter as inner shell assembly 12 and inner shell segments 14*a*-*b*, and the outer shell assembly will be referred to as outer shell assembly 20.

The system 10 also includes at least one key structure 28. As will be discussed further along in the description, the key structure 28, and the manner in which it functions in conjunction with the surfaces (particularly the tapered surface 26) of the groove 16, is a critical component to formation of a seal between the inner shell assembly 12 and outer shell assembly 20. The key structure 28 is disposable in the groove 16 between the sealing surface 21 of the tongue 18 and at least one of (depending on which part of the key structure 28 is being referred to) the alignment slot 22, the association surface 24, and the tapered surface 26. In an exemplary embodiment, the groove 16 defined by each inner shell segment 14*a-b* will include the key structure 28.

The key structure 28 includes an alignment segment 30 and a seal segment 32. The alignment segment 30 is disposed in the alignment slots 22 of the groove 16, and aids in key structure 28 alignment, as will be discussed further along in the disclosure. In an exemplary embodiment, the seal segment 32 includes a tapered portion 33 that is associable and mateable with the tapered surface 26 of the groove 16. The seal segment 32 may be referred to as having two sections; a sealing section 32*a* and an associating section 32*b*. The sealing section 32*a* may extend 360 degrees around the entire groove 16, and may include a sealing arrangement 34, such as a pliant flex-rope 35 disposed in a rope groove 36 (the rope groove 36 being defined by the seal segment 32), a C seal, an M seal or a configuration of radial teeth. The association section 32*b* (which may or may not extend 360 degrees around the groove 16) associates the key structure 28 with the inner shell segments 14*a-b* at the association surface 24 of the groove 16. In an exemplary embodiment, the association section 32*b* defines at least one axial slot 38 and the association surface 24 defines at least one threaded cavity 40, wherein at least one threaded instrument 42 is threaded through the axial slot 38 and the threaded cavity 40 to associate the key structure 28 with the inner shell segment 14*a* or 14*b*. It should be appreciated that the axial slot(s) 38 are configured to allow axial movement of the key structure 28 relative to the threaded instrument 42, which will be in fixed association with the association surface 40. Allowance of this movement is demonstrated by clearance gaps 44*a-b* between the threaded instrument and axial slot 38, as shown in FIG. 2.

In an exemplary embodiment, the system 10 may also include at least one actuator 46. The actuator 46 is disposed in the groove 16, and may be any device capable of actuating the seal portion 32 of the key structure 28 towards the tapered surface 26. By way of example, the actuator 46 may be a compression spring disposed between the seal portion 32 and a wall 48 of the groove 16.

With the components of the system 10 described above, the manner in which the system 10 aligns and seals will now be discussed. Referring to alignment, the inner shell assembly 12 is axially aligned with the outer shell assembly 20 via a 360 degree tongue 18 and groove 16 fit. This fit entails metal-to-metal contact between the inner shell segments 14*a-b* and outer shell segments (of which the turbine outer shell assembly 20 is comprised), and maintains a correct axial position of the inner shell assembly 12. In an exemplary embodiment, the groove 16 will include a width 70 that is large enough to accommodate distortion in side walls 72*a-b* of the tongue 18. The key structure 28 is also aligned with the inner shell segments 14*a-b* (one key structure 28 for each inner shell segment in an exemplary embodiment) via disposal of the alignment segment 30 in the alignment slots 22 found in the groove 16. In an exemplary embodiment, the alignment slots 22 are disposed at a relative center of each inner shell segment 14*a* or 14*b*, with the threaded instruments 42 associating the seal segment 32 (particularly association section 32*b*) with the association surface 24 at each relative side of the alignment slot 22 of the particular inner shell segment 14*a* or 14*b*.

In systems that do not include the components of the system 10, the tongue 18 and groove 16 fit would also be primarily responsible for creating a pressure seal that divides a high-pressure exhaust region 50 from a hot reheat region 52. While this fit is partly responsible for the pressure seal created by the system 10, the key structure 28 increases the effectiveness of the seal, helping to eliminate the need to field machine the side wall surfaces 72*a-b* of the tongue 18 during retrofitting.

Referring to creation of seals in the system 10, the key structure 28 creates a pressure seal against the segments of both the inner shell assembly 12 and outer shell assembly 20. Referring to the inner shell assembly 12, an inner pressure seal 54 is creatable at contact between the tapered surface 26 of the groove 16 and the tapered portion 33 of the seal segment 32. The tapered portion 33 is configured to align with tapered surface 26 by virtue of running at substantially the same angle as the tapered surface 26. Due to pressurized fluid flowing into and creating the high pressure exhaust region 50, and/or applied force from the actuator 46, the tapered portion 33 is forced into contact with the tapered surface 26. In an exemplary embodiment, this contact creates the inner pressure seal 54. In addition, the pressure drop and/or force from the actuator 46 causes the seal segment 32 (along with the rest of the key structure 28) to move/slide along the tapered surface 26, towards contact with the sealing surface 21 of the tongue 18. Guidance via the angle of both the tapered surface 26 and tapered portion 33 at contact, along with the force(s) supplied, creates this resultant movement towards the sealing surface 21.

Although an exemplary embodiment includes the tapered portion 33 of the key structure 28, it should be appreciated that any portion of the key structure 28 may be designed to contact, align, and/or seal with the tapered surface 26. This optional portion of the key structure 28 may not be tapered like the tapered portion 33, instead aligning/mating with the tapered surface 26 via any other means of association, such as a tongue-groove fit, wherein the key structure would include a tongue and the tapered surface 26 would include a groove. In addition, while an exemplary embodiment also includes a key structure 28 that forms the inner pressure seal 54, the key structure 28 (tapered portion 33 or otherwise) may also be merely associable with the tapered surface 26, acting as a guide, but not forming the inner pressure seal 54.

Referring now to creation of a seal with the outer shell assembly 20, the key structure 28 moves towards the sealing surface 21 of the tongue 18 until the sealing arrangement 34 of the seal section 32 contacts the sealing surface 21, and creates an outer pressure seal 56. This is the pressure seal against the outer shell assembly 20 referred to above. Once both the outer pressure seal 56 been established via the initial pressure drop (between the hot reheat region 52 and high pressure exhaust region 50) and/or actuator 46, pressure differential between the high-pressure exhaust region 50 and the hot reheat region 52 builds, further strengthening the seal 56. The outer pressure seal 56 created by the system 10 eliminates the need to field machine creep and distortion (cause by high temperature and pressure conditions over time and usage) out of the sealing surface 21 of the tongue 18 during retrofit with the groove 16 of a new inner shell segment. This outer pressure seal 56 can be achieved without machining the side wall surfaces 72*a-b* to include(or regain) a surface that is perpendicular with respect to a turbine centerline. This is because the sealing arrangements 34 (such as the pliant flex-rope 35 disposed in the rope groove 36, or the configuration of radial teeth) will be pushed into contact and seal with the sealing surface 21, and this contact will create a seal. Thus, machining of the tongue 18 for retrofit, and the costs associated with this machining, are eliminated.

Referring particularly now to FIG. 2, the segments 14*a* and 14*b* align at butt joint 90, via a joint tongue 91 and a joint groove 92. It should be appreciated that the key structure 28, particularly the tapered portion 33 of the sealing section 32*a*, runs through the butt joint 90, allowing for creation of a seal in this segment aligning butt joint region.

Figure 4:
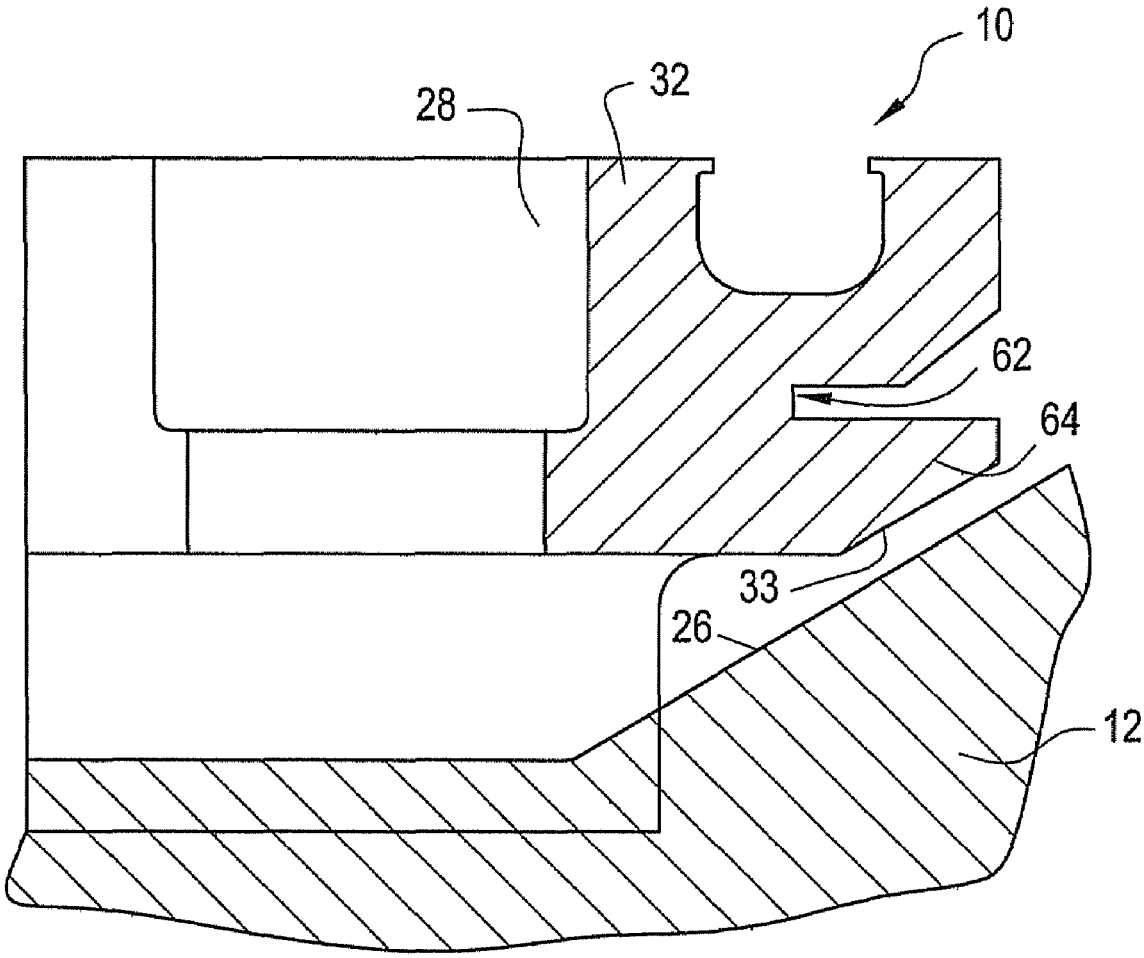
FIG. 4 is a schematic, cross-sectional view of an axial tongue and groove fit in a system for aligning and sealing a turbine shell assembly including a flex key 62.

Referring to FIG. 4, an embodiment of the system 10 including a flex cavity 62 and a compression flange 64 is illustrated. The flex cavity 62 and compressing flange 64 are defined by the seal section 32 of the key structure 28. Seal section's 32 that include the flex cavity 62 have a decreased stiffness due to an ability of the compressing flange 64 to compress into the flex cavity 62 when the inner pressure seal 54 is formed. This "softer" seal section 32 decreases potential for damage due to stress on the shell segments of the inner shell assembly 12 and outer shell assembly 20.

Figure 5:
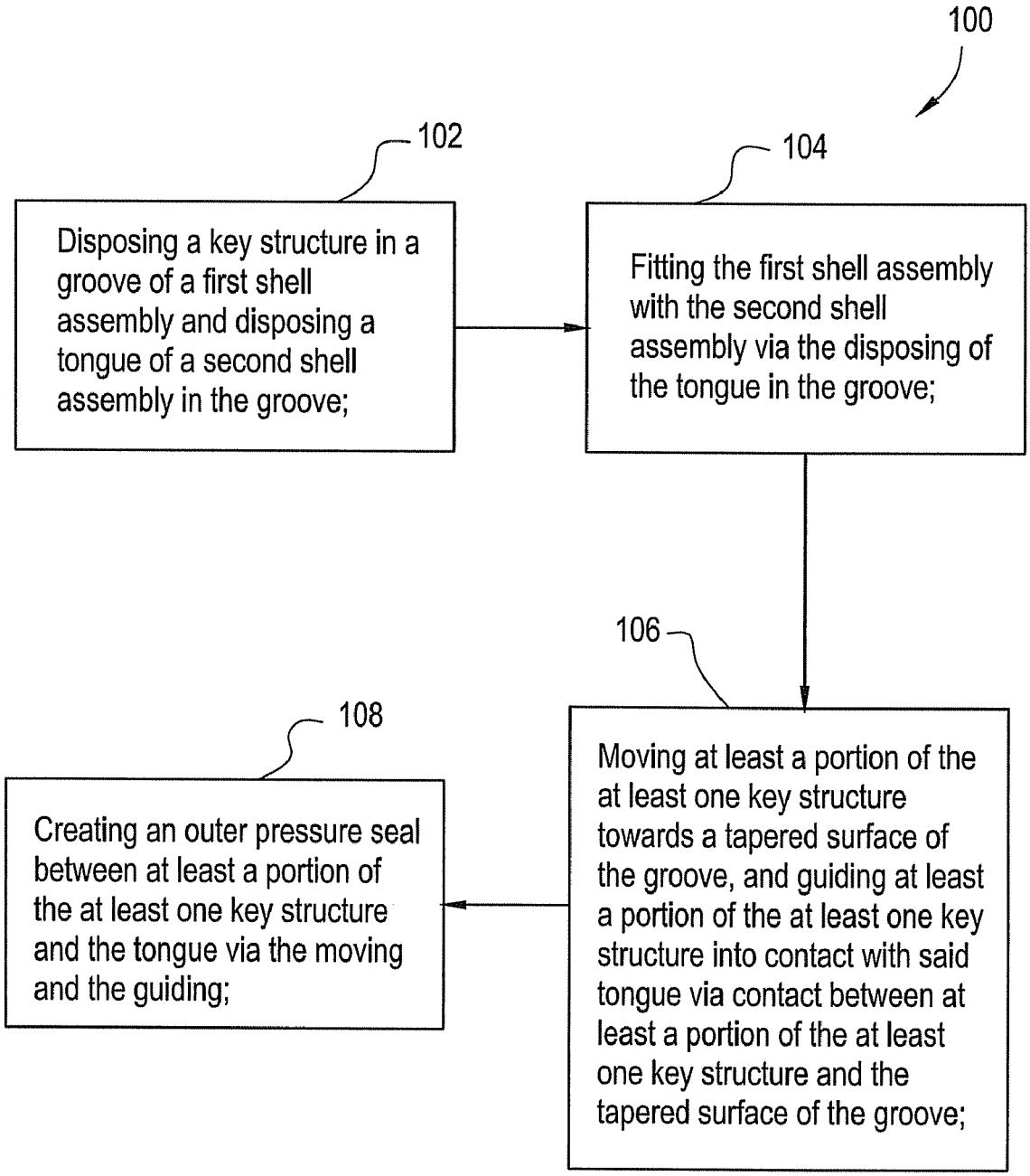
FIG. 5 is a block diagram illustrating a method for aligning and sealing a turbine shell assembly.

Referring to FIG. 5, a method 100 for aligning and sealing a turbine shell assembly is illustrated and includes disposing a key structure 28 in a groove 16 of a first shell assembly 12 and disposing a tongue 18 of an second shell assembly 20 in the groove 16, as shown in operational block 102. The groove 16 may run 360 degrees around the first shell assembly 12 (which includes at least one first shell segment 14*a-b*), and the tongue 18 may be disposed in the groove 16 at 360 degrees around the groove 16. The method 100 also includes fitting the first shell assembly 12 with the second shell assembly 20 via the disposing of the tongue 18 in the groove 16, as shown in operational block 104. The key structure 28 may also be associated and fit with the first shell assembly 12 via a fitting of an alignment segment 30 of each key structure 28 into an alignment slot 22 in the groove 16, and a threading of the at least one key structure 28 to the first shell assembly 12 via at least one threaded instrument 42 being thread through at least one axial slot 38 into at least one threaded cavity 40 defined by the first shell assembly 12.

The method 100 additionally includes moving at least a portion of the at least one key structure 28 towards a tapered surface 26 of the groove 16, and guiding at least a portion of the at least one key structure 28 into contact with said tongue 18 via contact between at least a portion of the at least one key structure 28 and the tapered surface 26 of the groove 16, as shown in operational block 106. In an exemplary embodiment, the portion of the key structure 28 that would contact the tapered surface 26 would be a tapered portion 33, and this contact would allow creation of an inner pressure seal 54 between the tapered portion 33 and the tapered surface 26. Further included in the method 100 is creating an outer pressure seal 56 between at least a portion of the at least one key structure 28 and the tongue 18 via the moving and the guiding, as shown in operational block 108. Both the inner and outer pressure seals 54 and 56 may seal with the first shell assembly 12 and tongue 18 respectively at 360 degrees around the groove 16. Also, the inner and outer pressure seals 54 and 56 may be actuating the key structure 28 into a position that forms the inner and outer pressure seals 54 and 56 via at least one of an actuator 46 and a pressure differential between a high-pressure exhaust region 50 and a hot reheat region 54 of the groove 16.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A system for aligning and sealing a turbine shell assembly, the system comprising:

an first shell assembly including at least one first shell segment;

a second shell assembly including a tongue extending therefrom;

a groove defined by said first shell assembly, said groove configured to mate with said tongue extending from said second shell assembly;

at least one key structure disposable in said groove, said at least one key structure being associable with at least one surface of said at least one first shell segment, and at least partially sealable with a sealing surface of said tongue; and a tapered surface of said groove that is associable with at least a portion of said at least one key structure.

2. A system according to claim 1, wherein said groove runs 360 degrees around said first shell assembly, and said tongue is fitable into said groove at 360 degrees around said groove.

3. A system according to claim 2, wherein each of said at least one key structures includes a seal segment that is sealable with said sealing surface of said tongue at 360 degrees around said groove, and an alignment segment that is disposable within an alignment slot disposed in said groove and defined by each of said at least one said first shell segments.

4. A system according to claim 3, wherein said seal segment includes a sealing arrangement, said sealing arrangement allowing sealability of said seal segment and said sealing surface of said tongue.

5. A system according to claim 4, wherein said sealing arrangement is at least one of a pliant flex-rope, a C seal, an M seal, and a configuration of radial teeth disposed in a rope groove defined by said seal segment.

6. A system according to claim 3, wherein said seal segment defines at least one axial slot and said first shell segments defines at least one threaded cavity, said key structure and said first shell segments being associated via at least one threaded instrument threaded through said at least one axial slot and said at least one threaded cavity.

7. A system according to claim 6, wherein said at least one axial slot is configured to allow axial movement of said key structure.

8. A system according to claim 3, wherein said seal segment includes a flex cavity.

9. A system according to claim 1, further including at least one actuator disposed in said groove and capable of actuating at least a portion of said key structure towards said tapered surface.

10. A system according to claim 1, wherein said first shell assembly is an inner shell assembly including at least one inner shell segment and said second shell assembly is an outer shell assembly.

11. A system according to claim 1, wherein said tapered surface of said groove is sealable with a tapered portion of said at least one key structure.

12. A system according to claim 1, wherein said first shell assembly is an outer shell assembly including at least one outer shell segment and said second shell assembly is an inner shell assembly.

13. A method for aligning and sealing a turbine shell assembly, the method comprising:

disposing at least one key structure in a groove of a first shell assembly;

disposing a tongue of a second shell assembly in said groove, fitting said first shell assembly with said second shell assembly via said disposing of said tongue in said groove;

moving at least a portion of said at least one key structure towards a tapered surface of said groove;

guiding at least a portion of said at least one key structure into contact with said tongue via contact between at least a portion of said at least one key structure and said tapered surface of said groove; and creating an outer pressure seal between at least a portion of said at least one key structure and said tongue via said moving and said guiding.

14. A method according to claim 13, wherein said disposing said tongue in said groove includes disposing said tongue in said groove at 360 degrees around said groove.

15. A method according to claim 14, wherein said creating said outer pressure seal includes creating said outer pressure seal between said at least one key structure and said tongue at 360 degrees around said groove.

16. A method according to claim 13, further including creating an inner pressure seal between at least apportion of said at least one key structure and said tapered surface of said groove.

17. A method according to claim 16, wherein said disposing said tongue in said groove includes disposing said tongue in said groove at 360 degrees around said groove, and wherein said creating said first pressure seal includes creating said first pressure seal between said at least one key structure and said first shell assembly at 360 degrees around said groove, and said creating said outer pressure seal includes creating said outer pressure seal between said at least one key structure and said tongue at 360 degrees around said groove.

18. A method according to claim 13, wherein said moving further includes actuating said at least one key structure into a position that forms said inner pressure seal and said outer pressure seal via at least one of an actuator and a pressure differential between a high-pressure exhaust region and a hot reheat region of said groove.

19. A method according to claim 13, further including associating said at least one key structure with said first shell assembly via at least one threaded instrument.

20. A method according to claim 13, wherein said creating of said outer pressure seal includes contacting a sealing surface of said tongue with a sealing arrangement of said key structure.

* * * * *